US007326887B1

(12) United States Patent
Sullivan et al.

(10) Patent No.: US 7,326,887 B1
(45) Date of Patent: Feb. 5, 2008

(54) MODIFIED RESET MOTOR PROTECTOR

(75) Inventors: Steven K. Sullivan, Cranston, RI (US); Jonathan F. Cohen, Douglas, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 11/610,117

(22) Filed: Dec. 13, 2006

(51) Int. Cl.
*H05B 1/02* (2006.01)

(52) U.S. Cl. ..... 219/505; 219/504; 219/508; 219/481; 219/494; 307/117

(58) Field of Classification Search ..... 219/504, 219/505, 481, 507, 508, 501, 494, 497; 307/117
See application file for complete search history.

(56) References Cited

U.S. PATENT DOCUMENTS 3,525,914 A 8/1970 Vind
3,914,727 A * 10/1975 Fabricius ..... 338/22 R
5,256,857 A * 10/1993 Curhan et al. ..... 219/202
5,607,610 A * 3/1997 Furukawa ..... 219/505
5,615,072 A 3/1997 Hofsass
6,020,807 A 2/2000 Givler

OTHER PUBLICATIONS

Advertising Brochure which shows a PTC heater clipped to an external surface of a protector housing.

* cited by examiner

*Primary Examiner*—Mark Paschall
(74) *Attorney, Agent, or Firm*—Russell E. Baumann

(57) ABSTRACT

A self-hold motor protector (10) has an open metallic housing (12) in which a thermostatic disc (14) carrying a movable electrical contact (18) is cantilever mounted. A heater seat plate (20) is mounted in the housing in electrical and thermal relationship therewith. The heater seat plate has a seating recess (20*a*) in which a positive temperature coefficient resistor heating element (22) is received with one contact surface in electrical and thermal engagement with the heater seat plate. A terminal plate (26) mounts a stationary electrical contact (28) and is received over the opening of the housing but electrically isolated therefrom by a gasket (24). An electrically conductive spring (30) extends between the terminal plate and a second contact surface of the heating element.

13 Claims, 4 Drawing Sheets

MODIFIED RESET MOTOR PROTECTOR

FIELD OF THE INVENTION

This invention relates generally to engine cooling system motors that drive radiator fans in automotive applications and more particularly, to apparatus for protecting such motors from over-temperature operation during high-speed locked-rotor conditions.

BACKGROUND OF THE INVENTION

Engine cooling system (ECS) brush-commutated motors that drive radiator fans in automotive applications do not presently include effective protection for motor winding insulation and brushes from over-temperature operation during high-speed locked-rotor conditions. Recent automotive recalls for radiator fan motor fires have resulted in the development of specifications for motor protection at the ECS system and motor manufacturer level. Manufacturers prefer modified reset (SAE type II) locked-rotor protection which does not automatically reset after trip; protecting consumers from personal injury due to unexpected fan blade rotation and increasing locked-rotor event reliability at 150 A/15 Vdc and 300 A/24 Vdc conditions.

Any protector used for this purpose must be able to withstand underhood environmental conditions and preferably be adapted for mounting within the motor on the brush card in order to minimize salt spray degradation and optimize thermal sensitivity as well as to increase the motor manufacturer's value added.

So-called self-hold protectors in which electrical contacts of a protector are maintained in the open contacts position following actuation to interrupt current to a load due to an overload until power is removed from the protector are known. For example, in UK Patent Application GB 2252674A, published Aug. 12, 1992, a positive temperature coefficient of resistivity (PTC) heating element is received in a molded plastic housing that also mounts a snap-acting bimetal switch actuating element in heat conductive relation with the PTC element. Upon overheating of an appliance with which the protector is used, the snap-acting element actuates to open the contacts interrupting the load current and causing current to flow through the PTC element which self-heats to a high-resistance temperature thereby maintaining the snap-acting element in the actuated position with minimal current then passing through the PTC element. This device would not be useful in an automotive underhood environment, among other reasons, due to the fact that the various components are not sealed off from the environment and would be subject to deterioration from salt spray and the like.

Another example is shown in U.S. Pat. No. 6,020,807 that issued Feb. 1, 2000. The protector of this patent comprises a can shaped, electrically conductive metallic housing in which a bimetal blade is cantilever mounted on the bottom wall of the housing, the blade mounting a movable electrical contact on the free end thereof and movable into and out of engagement with a stationary contact mounted on an electrically conductive cover plate that is mounted on the housing through an insulating sheet. A PTC element is mounted between and in electrical engagement with the cover plate and the fixed end of the bimetal blade. The bimetal blade carries the load current and when actuated causes the contacts to open thereby interrupting the load current and the blade is then maintained in the actuated position by heat from the PTC element which then limits the load current to a trickle level. In this arrangement, heat conduction between the PTC element and the bimetal blade is optimized due to the minimized thermal resistance between the two components. As a result, the arrangement limits the size and power produced by the PTC component to significantly affect all boundary conditions, limiting the useful self-hold function range relative to ambient temperature and voltage.

SUMMARY OF THE INVENTION

It is an object of the present invention to provide a motor protector particularly adapted to protect automotive engine cooling system motors from locked-rotor conditions. Another object of the invention is the provision of a motor protector suitable for use in an automotive underhood environment and one that has a modified reset capability. Still another object is the provision of such a motor protector which is easily manufactured and assembled, is reliable, long lasting and relatively inexpensive. Still another object of the invention is the provision of a motor protector that has a modified reset capability that is effective over wide voltage and ambient temperature conditions associated with automotive applications, typically −40 degrees C. to +110 degrees C. ambient and 9 Vdc to 16 Vdc potential.

Briefly, in accordance with the invention, a PTC (positive temperature coefficient) resistor is disposed in an environmentally sealed motor protector having a current carrying thermostatic disc mounted in a housing to avoid direct exposure to aggressive environmental conditions and efficiently elevate the internal ambient temperature of the motor protector and components over a wide range of voltage and external ambient temperature conditions. The motor protector comprises an electrically conductive metal housing having bottom and side walls and having a current-carrying snap-acting thermostatic disc, made of bimetal or the like, cantilever mounted on the bottom wall in a switch chamber of the motor protector. A movable electrical contact mounted at the free end of the disc is adapted to move into and out of engagement with a stationary electrical contact mounted on an electrically conductive metal heater/terminal plate member closing the switch chamber. An electrically conductive metal heater seat plate member, formed with a recess therein is received on a lip formed on the side walls of the housing so that the convex side of the recess is situated above and closely spaced from the thermostatic disc. The heater seat plate member is thermally and electrically connected to the housing. The heater seat plate member comprises a heat radiating surface generally coextensive with the disc, except for a portion mounting the movable electrical contact, enhancing convection heat transfer to the disc to supplement conduction heat transfer through the heater seat plate member, housing, spring and heater/terminal plate member to optimize the effectiveness of the self-hold function over the voltage and ambient temperature range required.

A positive temperature coefficient of resistivity (PTC) heater element having opposed contact surfaces is received in the recess with one contact surface in engagement with the bottom wall of the recess. An electrically conductive spring member is mounted on the heater/terminal plate member that, in the assembled protector, resiliently engages the other contact surface of the PTC element. An electrically insulating sheet is interposed between the heater/terminal plate member and the heater seat plate member and is clamped to the housing by a pair of extensions of the housing side walls that are bent over onto the heater/terminal plate member but electrically isolated therefrom by the electrically insulating sheet.

According to a feature of the invention, the recess of the heater seat plate member is formed with side walls that are inclined away from the interior of the recess to provide structure that prevents short circuiting across the contact layers of an electrical heater element having side surfaces that extend generally normal to the opposed contact layers thereof.

According to another feature of the invention the heater element is a positive temperature coefficient resistor (PTC) element formed of either a ceramic or polymer PTC material. In the preferred embodiment described herein, an electrically conductive fluoropolymer, ECTFE, is employed.

In the preferred embodiment described herein, the PTC heater element is coupled to the thermostatic disc both electrically and thermally through the physical engagement of the metal heater seat plate member and the metal housing. According to a modified preferred embodiment, this coupling is enhanced by a second path comprising an extension of the fixed end of the thermostatic disc that is bent back into a generally U-shaped configuration with the free end thereof engaging the heater seat plate member. In another modified preferred embodiment, a strip of the heater seat plate extends therefrom and is placed in engagement with the attachment slug of the thermostatic disc.

The thermostatic disc's low-resistance current path carries load current during normal operation. A locked rotor condition increases the ampere level by 4-6 times thereby generating sufficient $i^2r$ heat to cause the thermostatic disc to actuate thereby opening the contact system. System voltage is then dropped across the high-resistance PTC heater element which produces sufficient power and surface temperature to keep the thermostatic disc from resetting until the potential is removed.

BRIEF DESCRIPTION OF THE DRAWINGS

The above objects, features and advantages of the present invention will become apparent upon consideration of the following detailed description when taken in conjunction with the accompanying drawings wherein like reference characters in the several figures are utilized to designate like components, and wherein.

DETAILED DESCRIPTION OF PREFERRED EMBODIMENT

Figure 1:
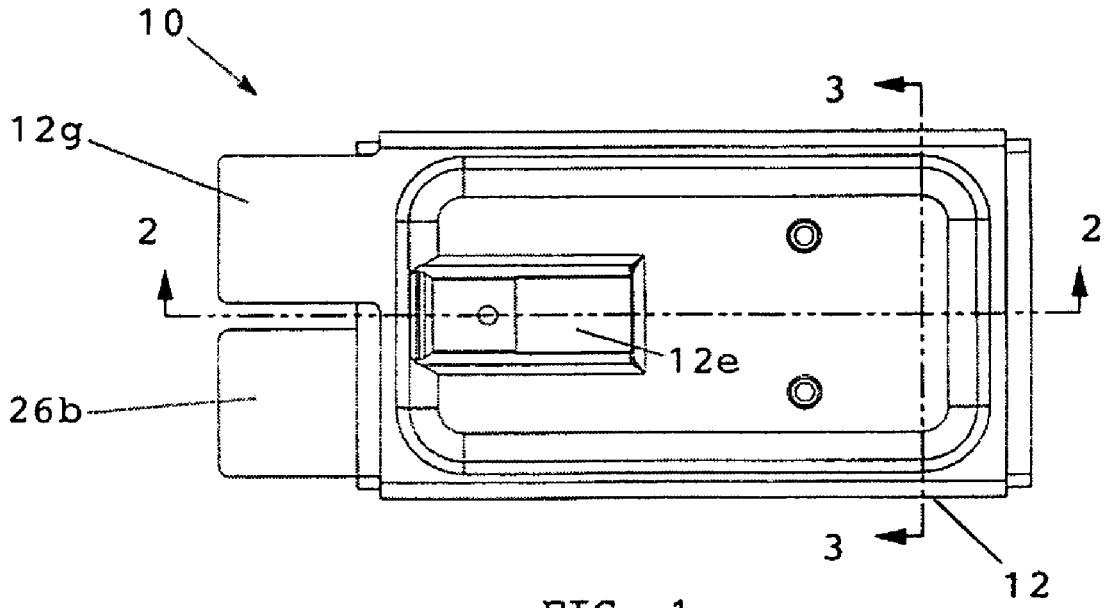
FIG. 1 is a top plan view of an automotive motor protector made in accordance with the preferred embodiment of the invention.

With reference to the drawings, particularly FIGS. 1-8, an automotive motor protector 10 having a modified reset feature made in accordance with the preferred embodiment of the invention comprises an electrically conductive metal housing 12, shown bottom side up in the drawings, having a generally rectangular bottom wall 12*a* and a side wall 12*b* forming a switch chamber 12*c* open at the top thereof. Side wall 12*b* has a free end that is bent outwardly to form a lip 12*d* around the periphery of the housing. A snap-acting thermostatic disc 14 having opposite end portions 14*a*, 14*b* is cantilever mounted at end portion 14*a* to bottom wall 12*a* of the housing on a recessed mounting platform 12*e*, displaced into the switch chamber, as by welding at slug 16. A movable electrical contact 18 is mounted on thermostatic disc 14 at the free, second end portion 14*b* on the face side of the disc facing away from bottom wall 12*a*.

Figure 2:
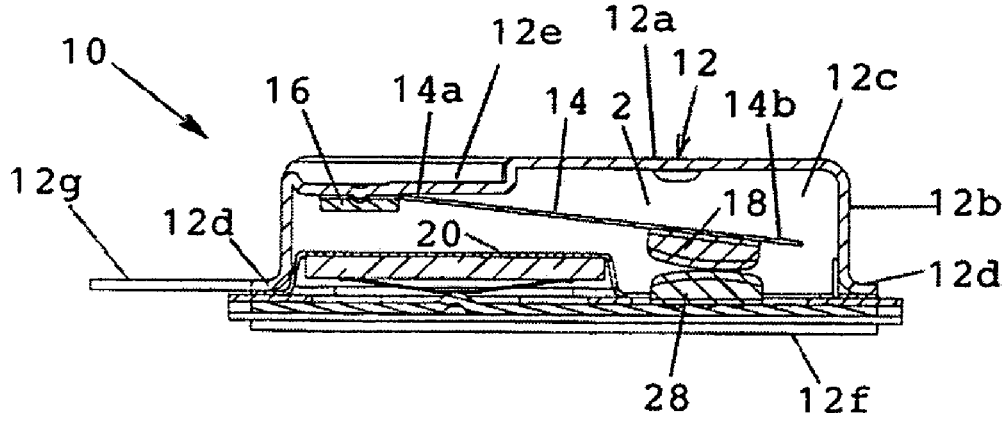
FIG. 2 is an elevational cross section taken on line 2-2 of FIG. 1.
Figure 3:
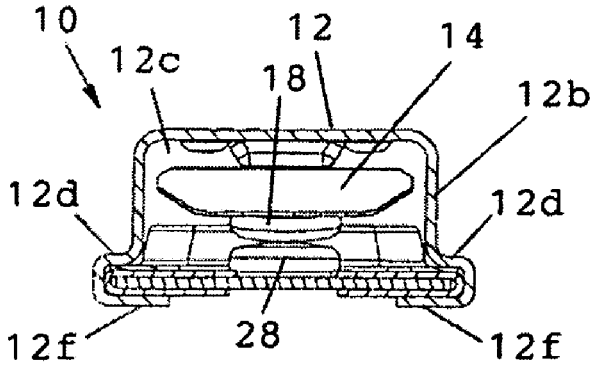
FIG. 3 is an elevational cross section taken on line 3-3 of FIG. 1.
Figure 4:
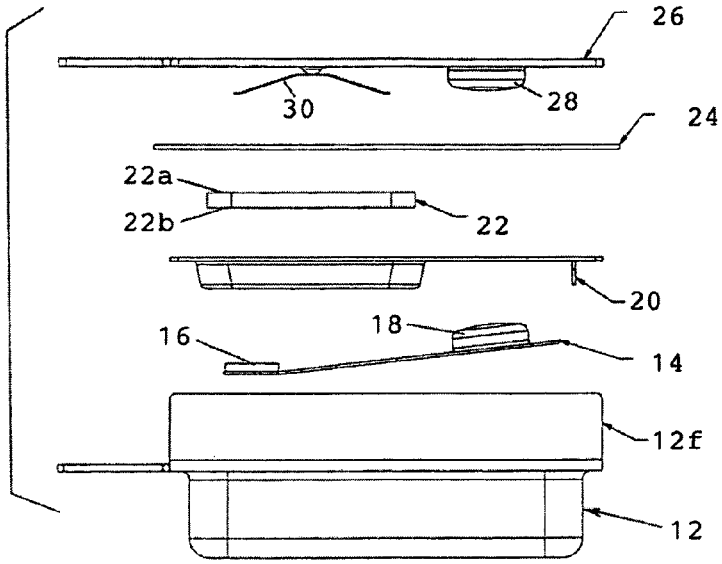
FIG. 4 is an exploded front elevational view of the FIG. 1 protector.
Figure 5:
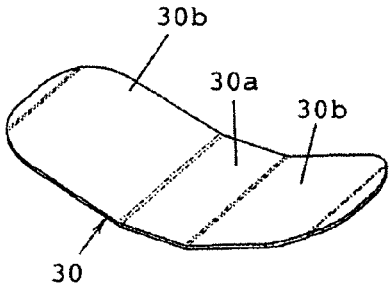
FIG. 5 is a perspective view of a PTC heater element contacting spring used in the FIG. 1 protector.
Figure 6:
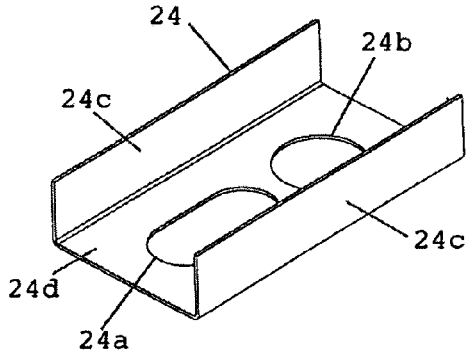
FIG. 6 is a perspective view of an electrically insulating sheet used in the FIG. 1 protector.
Figure 7:
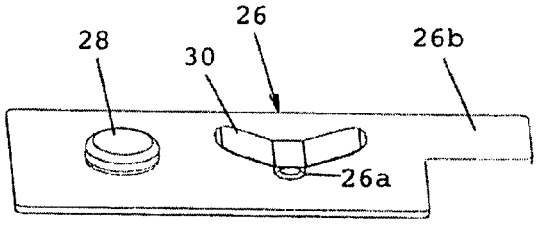
FIG. 7 is a perspective view of a heater/terminal plate assembly used in the FIG. 1 protector.
Figure 8:
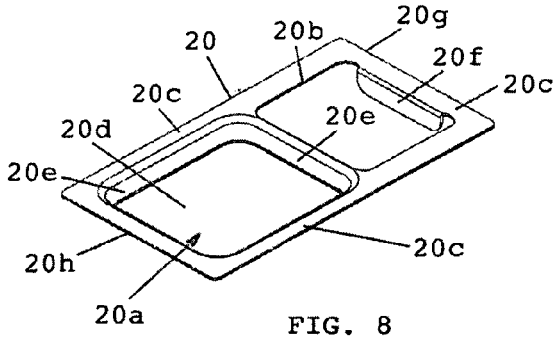
FIG. 8 is a perspective view of a heater seat plate member used in the FIG. 1 protector.

A metal heater seat plate member 20, see FIG. 8, is formed of suitable heat and electrical conducting material, such as nickel zinc plated steel or bronze, with a drawn recess 20*a*, an opening 20*b* and a lip 20*c* extending outwardly around the periphery of plate 20 that matches lip 12*d* of the housing and is disposed thereon as shown in FIGS. 2 and 3. Recess 20*a* has a flat bottom wall 20*d* and a side wall 20*e* that is inclined slightly, i.e., greater than 1 degree from normal, extending from the bottom wall in a direction away from the center of the recess providing a structural arrangement that avoids short circuiting of a heating element placed therein, to be discussed. Plate 20 is also preferably provided with a tab 20*f* that depends downwardly from lip 20*c* defining a side of opening 20*b* at end 20*g* of plate 20 with the tab serving as an alignment feature for assembling the protector, along with side wall 20*e* of the recess at end 20*h* of plate 20, received at the opening of switch chamber 12*c* of the housing and with the convex side of recess 20*a* extending into the switch chamber.

A PTC resistor heating element 22, generally in the configuration of a flat rectangular plate of material corresponding to but slightly smaller than the shape of the bottom wall 20*d* of recess 20*a* of the heater seat plate. The PTC heater element has side walls that are essentially normal with the face surfaces 22*a*, 22*b* (FIG. 4) on which the electrical contact layers are disposed, and when placed into the recessed seat 20*a* having the inclined side walls 20*e* of the heater seat plate, the likelihood of shorting between the contact layers is essentially eliminated. The PTC heater element may be formed of ceramic, such as barium titanate doped with a rare earth, know in the art, or a polymer PTC material. In the present embodiment, the PTC resistor heater element is formed of a polymer positive temperature coefficient (PPTC); such material having several advantages in high volume manufacturing and physical attributes compared to ceramic based materials. For example, PPTC elements are less expensive to manufacture, are available in lower resistivities to produce required power at low voltage conditions and are less sensitive to thermal shock cracking issues relative to ceramic elements.

Locating the PPTC element spaced apart from the thermostatic disc results in a thermal gradient issue that must be managed to prevent the disc from resetting at −40 degrees C. ambient and 9 Vdc power conditions. Conventional PPTC protection devices for automotive applications are designed to trip at 120 to 137 degrees C. using electrically conductive polymer HDPE (high density polyethylene) and 134 to 169 degrees C. using electrically conductive polymer PVDF (polyvinylidene fluoride). The minimum reset temperature of the thermostatic disc is typically 70 degrees C. due to automotive manufacturers' specifications and the protection devices operating requirements.

The above noted thermal gradient issues involved with the preferred embodiment can be managed using switching temperatures between 180 and 260 degrees C. using selected electrically conductive fluoropolymer compositions and their associated melt temperatures available from Polytronics Incorporated of Taiwan. For example, such materials include electrically conductive polymer ETFE (ethylene tetrafluoroethylene, e.g., Fluon) 260 degrees C. melting temperature; electrically conductive polymer ECTFE (ethylene chloro-trifluoroethylene, e.g., Halar) 240 degrees C. melting temperature and electrically conductive polymer PCTFE (polychlorotrifluoroethylene, e.g., Neoflon) 210 degrees C. melting temperature.

PPTC heater element 22 of the preferred embodiment comprises an electrically conductive, partially cross-linked ECTFE material system that switches at approximately 240 degrees C. and results in preventing undesired electrical contact resetting at −40 degrees C. while also allowing the use of conventional Nomex gasket electrical insulation materials, to be discussed, without causing thermal degradation of the insulation material. PPTC heater element 22 comprises a layer of carbon filled polymer with a coating of conductive material, such as nickel, on opposed face surfaces 22*a*, 22*b*. PPTC heater element 22 has a resistance of approximately 0.3 to 0.5 ohms at a temperature of 25 degrees C. Electrical insulating gasket 24 of suitable material, such as Nomex referenced above, is used to electrically isolate housing 12 and heater seat plate member 20 from heater/terminal plate member 26. Gasket 24 has cut-out windows 24*a*, 24*b* in a base portion 24*d* and is in the form of a generally rectangular sheet having two opposed flaps 24*c*, preferably pre-bent to extend upwardly from a flat base portion 24*d*. The gasket is received on lip 20*c* of the heater seat plate member and extends slightly beyond the lip on two opposed ends while flaps 24*c* extend upwardly along the sides and beyond corresponding flap extensions 12*f* (one being shown in FIG. 4) of housing 12. Windows 24*a* and 24*b* are provided for access to switching chamber 12*c* for a spring contact and a stationary contact to be discussed.

A heater/terminal plate member 26, preferably formed of a conventional heater material such as nickel zinc plated steel, bronze, or stainless steel for low power ratings, is configured to extend over the switching chamber and to be receivable on the base portion 24*d* of gasket 24 and aligned with lips 12*d* of housing 12 and 20*c* of heater seat plate member 20. A stationary electrical contact 28 is mounted on the heater/terminal plate member, as by welding thereto, at a location selected to be in alignment with window 24*b* of gasket 24 and with contact 18 which is adapted to move into and out of electrical engagement with the stationary contact. Also mounted on heater/terminal plate member 26 is a contact spring 30 formed of suitable electrically conductive, spring material, such as stainless steel. The spring has a pair of upwardly extending wings 30*b* extending from a base portion 30*a*. A laterally extending weld projection 26*a* is formed on terminal plate 26 to which base portion 30*a* is attached, as by welding thereto. Spring 30 extends through window 24*a* of the gasket and, following completion of the assembly by folding over flaps 12*f* of the housing to clamp the heater/terminal plate member, through gasket 24, the spring engaging PPTC element 22. A terminal portion 26*b* extends lengthwise from the plate for connection to the electrical circuit, along with a corresponding terminal plate 12*g* of housing 12.

Figure 9:
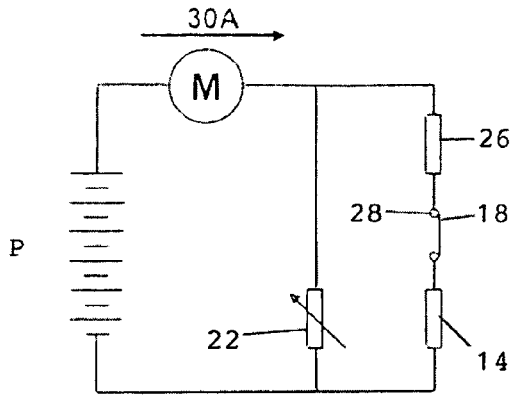
FIG. 9 is a simplified circuit diagram of the automotive electrical system, motor and protector made in accordance with the invention shown with the thermostatic disc in the closed circuit, normal operating condition.
Figure 10:
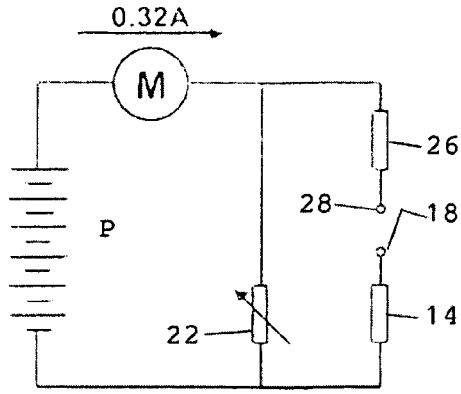
FIG. 10 is a circuit diagram as shown in FIG. 9 but shown with the thermostatic disc in the open, locked rotor condition.

With reference to FIGS. 9 and 10, a simplified circuit diagram shows an automotive power source P serially connected to a motor M of an engine cooling system and connected in parallel to PPTC heater element 22 and serially connected thermostatic disc 14, electrical contacts 18/28 and heater/terminal plate member 26. The diagram in FIG. 9 shows the circuit during normal operation and FIG. 10 shows the circuit in locked-rotor condition. The following example is given for a 400 watt engine cooling system (ECS) application carrying 30 amps. The low resistance thermostatic disc 14 and heater/terminal plate member path (approximately 2 m-ohms) carries the load current due to the relatively high resistance of the PPTC heater element of approximately 400 m-ohms. A locked-rotor condition decreases the impedance of the motor by approximately 80% producing a 135 amp locked rotor current. This causes $i^2r$ heating sufficient to actuate the thermostatic disc thereby opening contacts 18/28. System voltage is then applied to the PTC heater element elevating PPTC heater element 22 to its switching temperature at which point the PPTC heater element resistance increases exponentially to approximately 44 ohms producing 4.5 watts of power that keeps the thermostatic disc above the reset temperature. Load current is simultaneously decreased to 0.32 amps and the over temperature condition of the motor's internal components is eliminated.

Figure 11:
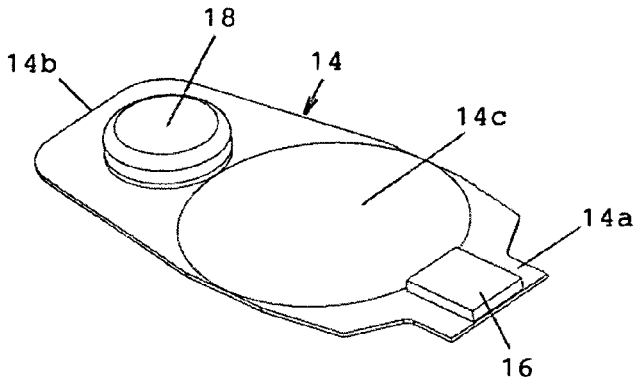
FIG. 11 is a perspective view of the thermostatic disc assembly used in the FIG. 1 protector.

A conventional thermostatic disc 14 is used in the preferred embodiment, shown in FIG. 11. A movable electrical contact 18 and a welding slug 16 are welded at opposite ends of the disc 14*b*, 14*a*, respectively. The center section 14*c*, between the welded components, is deformed in a known manner to produce a snap-acting thermostatic disc assembly leaving the material in the vicinity of the slug and electrical contact unformed to minimize fatigue stress associated with snap-action cycling.

Figure 12:
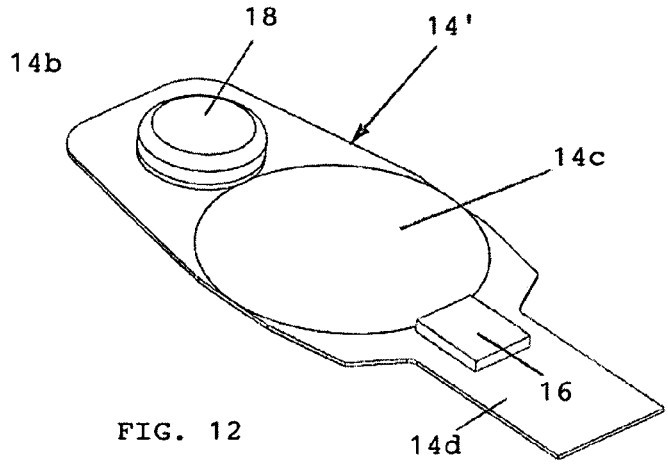
FIG. 12 is a perspective view of a thermostatic disc used in a modified preferred embodiment of the invention.
Figure 13:
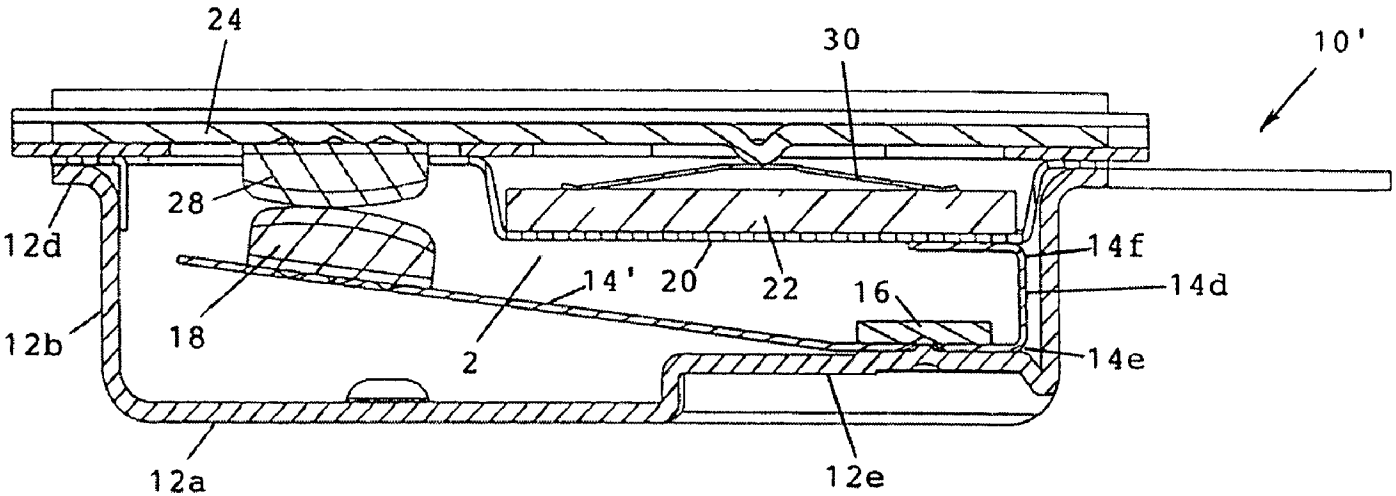
FIG. 13 is an enlarged cross section view similar to FIG. 1 but showing a modified embodiment employing the thermostatic disc of FIG. 12.

According to a modified embodiment 10', the disc 14', as shown in FIGS. 12 and 13, is extended beyond welding slug 16 to form an elongated strip 14*d*. Strip 14*d* is bent back over itself at 14*e* and 14*f* into a U-shape with the outer leg engaging the convex side of heater recess 20*a* of heater plate 20 forming an improved thermal path for an enhanced heat transfer and modified reset operation.

Figure 14:
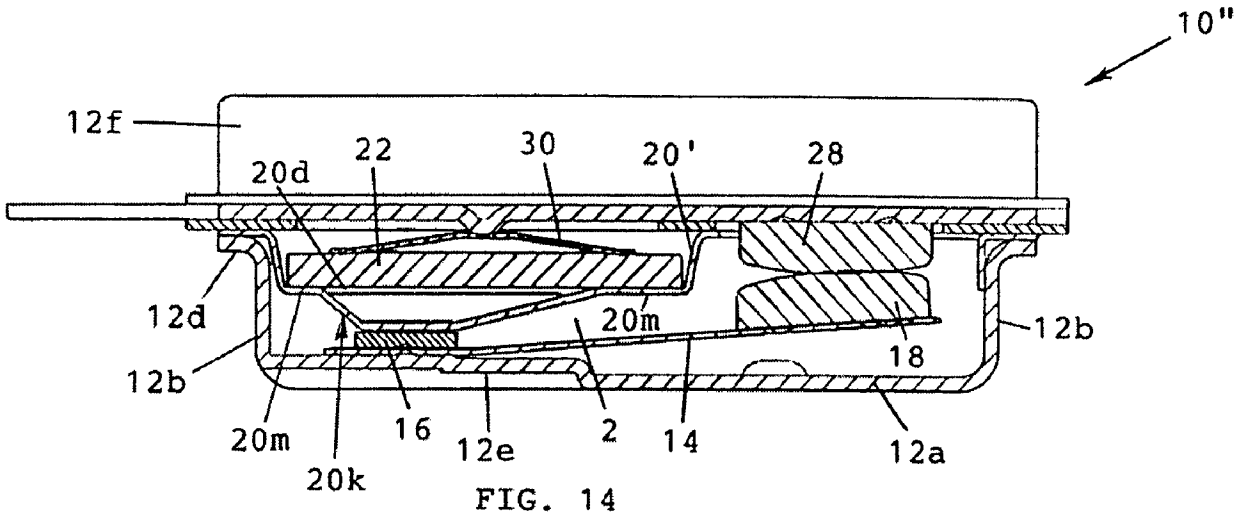
FIG. 14 is a slightly enlarged cross sectional elevational view of another modified preferred embodiment of the invention shown prior to bending of flap 24*c* for clamping the metal heater/element place member to the housing.

According to another modification 10" shown in FIG. 14, a bow shaped strip 20*k* extends from bottom wall 20*d* at two opposite end portions of recess 20*a* into engagement with welding slug 16 engaging the slug in thermal and electrical contact therewith to enhance heater transfer and modified reset operation. The bow shaped feature acts like a spring and deforms when slug 16 is pressed into it as the housing and disc assembly are deflected at 12*e* upon calibration of the protector.

Thus, in accordance with the invention, the thermostatic current path carries load current during normal operation. A locked-rotor condition increases the ampere level 4-6 times. The thermostatic disc is actuated as a result of the $i^2r$ heating that increases the temperature of the disc causing it to snap to the open contacts position. The system voltage is then dropped across the high resistance PPTC heater element which produces sufficient power and surface temperature to keep the thermostatic disc from resetting until the potential is removed.

The modified reset automotive protector of the invention provides maximum PTC element size and power generation to elevate the temperature of the entire assembly and maintain the disc in the actuated condition over wide voltage and ambient temperature conditions associated with automotive applications, typically 40 to 110 degrees C. and 9 to 16 Vdc. The structure optimizes convection heat transfer (air inside the housing) in addition to conduction heat transfer (the PTC heater seat plate member, housing, spring and heater/terminal plate member) to keep the disc from resetting at extreme conditions.

In addition, the structure of the invention facilitates high volume assembly and use of the PTC heater seat plate member air gap 2 conveniently enables calibration of the disc by means of plastic deformation of the housing at the weld slug location, not possible in the prior art design of the '807 patent referenced above.

It should be understood that the preferred embodiments have been described by way of illustrating the invention but that the invention includes various modifications and equivalents of the enclosed embodiments. It is intended to include all modifications and equivalents of the disclosed embodiments falling within the scope of the appended claims.

What is claimed:

1. An automotive motor protector particularly for underhood placement adapted to provide a modified reset operation upon actuation comprising:

a metallic housing having a bottom wall and side walls extending from the bottom wall to form a switching chamber, the walls extending to a selected location spaced from the bottom wall and extending generally laterally outwardly to form a first support lip around an opening to the chamber, a thermostatic, current carrying, disc having first and second end portions cantilever mounted at one end portion on the bottom wall within the switching chamber, a movable contact mounted on the disc adjacent to the second end portion and movable between first and second positions, a metal heater seat plate received on the first support lip, the heater seat plate being deformed to form a recess defined by a second bottom wall and side walls extending from the second bottom wall, the side walls extending a selected distance from the bottom wall and at the selected distance bent generally laterally outwardly to form a second support lip received on the first support lip, the heater seat plate formed with an opening aligned with the second end portion of the disc, a positive temperature coefficient resistor element having spaced apart first and second contact layers on opposed sides thereof and being disposed in the recess with one contact layer engaging the bottom wall of the recess, an electrically insulative sheet disposed on the second support lip, the insulative sheet having selected apertures therethrough, a terminal plate having a face surface mounting a stationary electrical contact and a metallic spring spaced apart from the stationary contact, the terminal plate received on the insulative sheet and overlying the first and second support lips, the stationary electrical contact and the spring being placed in respective alignment with the movable electrical contact and the positive temperature coefficient resistor element, the spring engaging the other contact layer of the positive temperature resistor element, the side walls of the housing being formed with first and second extensions extending from the first support lip and are bent over to clampingly engage the terminal plate through the insulative sheet with the spring making electrical engagement with the other contact layer of the positive temperature coefficient resistor element as well as biasing the positive temperature coefficient resistor element against the second bottom wall of the recess, the movable electrical contact being movable into and out of engagement with the stationary electrical contact, and first and second terminal portions are formed on and extend respectively from the housing and the terminal plate.

2. An automotive motor protector according to claim 1 in which the side walls of the heater seat plate recess are tilted to extend from the bottom wall slightly away from the interior of the recess greater than one degree.

3. An automotive motor protector according to claim 1 in which the heater seat plate has first and second opposed face surfaces forming opposed generally concave and convex surfaces defining the recess and the thermostatic disc is formed with an extension at the first end portion that is bent back over itself and having a portion that engages the heater seat plate on the convex surface.

4. An automotive motor protector according to claim 1 in which the thermostatic disc is attached to the housing a welding slug and an elongated strip of heat conductive material extends from the second bottom wall into thermal and electrical engagement with the said welding slug attached to the thermostatic disc.

5. An automotive motor protector according to claim 1 in which the positive temperature coefficient resistor comprises an electrically conductive, partially cross linked fluoropolymer from the group consisting of ECFTE, ETFE and PCTFE material systems.

6. An automotive motor protector according to claim 1 in which the positive temperature coefficient resistor comprises barium titanate doped with a rare earth.

7. A modified reset automotive motor protector for underhood placement comprising:

an electrically conductive metallic housing having a bottom wall an housing having a bottom wall and side walls extending from the bottom wall to form a switching chamber having an opening, the side walls extending from the bottom wall to form a switching chamber having an opening, the side walls having a distal free end formed with a laterally extending first support lip formed around the opening of the switching chamber, a thermostatic, current carrying snap-acting disc having first and second end portions, the disc cantilever mounted at the first end portion to the bottom wall of the housing, a movable electrical contact mounted at the second end portion of the disc, an electrically conductive metal heater seat plate formed with a recesses portion defined by a second bottom wall and a side wall extending from the bottom wall, a laterally extending second support lip formed about the periphery of the heater seat plate, the second support lip matching the configuration of the first support lip and being received thereon in heat and electrical conduction relation therewith, the recessed portion forming a concave heater seat surface and a convex outer surface, the convex outer surface facing the disc, an electrically conductive metal terminal plate having a face surface mounting a stationary electrical contact on the face surface received on the second support lip and electrically isolated from the housing and the heater seat plate, the movable electrical contact adapted to move into and out of engagement with the stationary electrical contact, a positive temperature coefficient resistor heating element having first and second opposed contact surfaces received on the concave heater seat surface, and an electrically conductive spring disposed between the terminal plate and the second contact surface of the heating element with the first contact surface in electrical engagement with the heater seat surface of the heater seat plate.

8. An automotive motor protector according to claim 7 further comprising an electrically conductive spring disposed between the heater seat plate and the weld slug of the thermostatic disc.

9. An automotive motor protector according to claim 7 which the side walls of the heater seat plate recess are tilted in a direction greater than approximately 1 degree from the interior of the recess.

10. An automotive motor protector according to claim 7 in which the heater seat plate has first and second opposed face surfaces forming opposed generally concave and convex surfaces defining the recess and the thermostatic disc is formed with an extension at the first end portion that is bent back over itself and having a portion that engages the heater seat plate on the convex surface.

11. An automotive motor protector according to claim 7 in which an elongated strip of heat conductive material extends from the second bottom wall into thermal engagement with the weld slug of the thermostatic disc.

12. An automotive motor protector according to claim 7 in which the positive temperature coefficient resistor heater element comprises an ECTFE polymer.

13. An automotive motor protector according to claim 7 further comprising alignment surfaces formed on the heater seat plate to permit self adjustment in assembly of the protector.

* * * * *